US005785061A

United States Patent [19]

Whiteley

[11] Patent Number: 5,785,061

[45] Date of Patent: Jul. 28, 1998

[54] ASHTRAY

[75] Inventor: Simon M. Whiteley, Hastings, England

[73] Assignee: U.S. Philips Corporation, New York, N.Y.

[21] Appl. No.: 841,916

[22] Filed: Apr. 17, 1997

[30] Foreign Application Priority Data

Apr. 25, 1996 [GB] United Kingdom ..... 9608509

[51] Int. Cl.[6] ..... A24F 19/00

[52] U.S. Cl. ..... 131/231; 131/238; 131/242; 55/316

[58] Field of Search ..... 131/231, 238, 131/242; 55/316, 385.11, 231, 476

[56] References Cited

U.S. PATENT DOCUMENTS

| | | | |
|---|---|---|---|
| 3,966,442 | 6/1976 | Waters | 55/316 |
| 4,161,181 | 7/1979 | Kicks et al. | 131/231 |
| 4,580,582 | 4/1986 | Grube et al. | 131/231 |

*Primary Examiner*—Aaron J. Lewis
*Assistant Examiner*—Charles W. Anderson
*Attorney, Agent, or Firm*—Laurie E. Gathman

[57] ABSTRACT

An ashtray houses a fan (20) which drives air through two filters (30, 36). Air is drawn in from an ashtray well (6) and expelled from openings (17) in the base of the ashtray. A recirculation path ($A_1$, $A_2$, $A_3$) is provided for pre-filtering by the first filter 30.

10 Claims, 2 Drawing Sheets

ASHTRAY

This invention relates to ashtrays.

A known ashtray comprises an enclosed chamber into which a cigarette end may be inserted by operating a lever on the ashtray. This enclosed chamber serves to extinguish the cigarette end by blocking the air supply, so that smoke is no longer given off. This has the advantage of reducing the amount of smoke given off by the cigarette, once the smoker has finished with the cigarette.

This device fails to reduce smoke which is produced when, for example, an unfinished cigarette is rested on the edge of the ashtray.

It is also known to provide air cleaners, for example in office environments, and it is also known to provide specific filters for such air cleaners for use by smokers. The present invention is concerned with the cleaning of air containing cigarette smoke.

According to the present invention, there is provided an ashtray comprising a casing housing a driven fan, the casing including at least one upper opening in an upper, external ashtray portion of the casing and at least one lower opening in a lower portion of the casing, the fan being disposed between, and generating a flow of air between, the upper portion and the lower portion of the casing, filtering means being located between the upper opening and the lower opening, an air return path being provided enabling the flow of air which has passed through the filtering means from within the casing to the ashtray portion of the casing.

The invention provides a combined ashtray and air filtering system within a single casing. In particular, recirculation is provided so that partially filtered air is returned to the astray portion, thereby increasing the filtering efficiency of the device.

The filtering means may comprise first and second filter means, the air return path enabling the flow of air from between the first and second filter means to the ashtray portion.

Thus, two filter means are provided within the ashtray and a recirculation ath is provided for air treated by the first filter.

Preferably, the upper opening is defined at a central portion of the ashtray, and the air return path is defined by at least one return opening in a peripheral area of the ashtray portion. In this way, the air return path promotes circulation of air to draw air away from the ashtray portion. This enables filtering of the smoke-filled air when the cigarette end is placed in the ashtray, and when an unfinished cigarette is rested on the ashtray portion.

The first filter means is preferably located in the air flow path between the upper opening and the fan, and the second filter means may be located in the air flow path between the fan and the lower opening. In this way, the fan housing may support the two filter means, with one filter means on either side of the fan. Thus, the ashtray preferably further comprises a filter support element comprising a fan housing portion including an upper support which supports the first filter means, lateral openings below the upper support, and a lower support disposed around the lateral openings and which supports the second filter means, the fan being positioned within the fan housing portion so as to draw air in through the first filter means and expel air through the lateral openings.

The first and second filter means may each comprise one or more filtering elements.

The fan is preferably a centrifugal fan and may be arranged in the casing such that air is drawn into the fan from above and is expelled laterally.

A preferred embodiment of the present invention will now be described, by way of example, with reference to the accompanying drawings in which.

Figure 1:
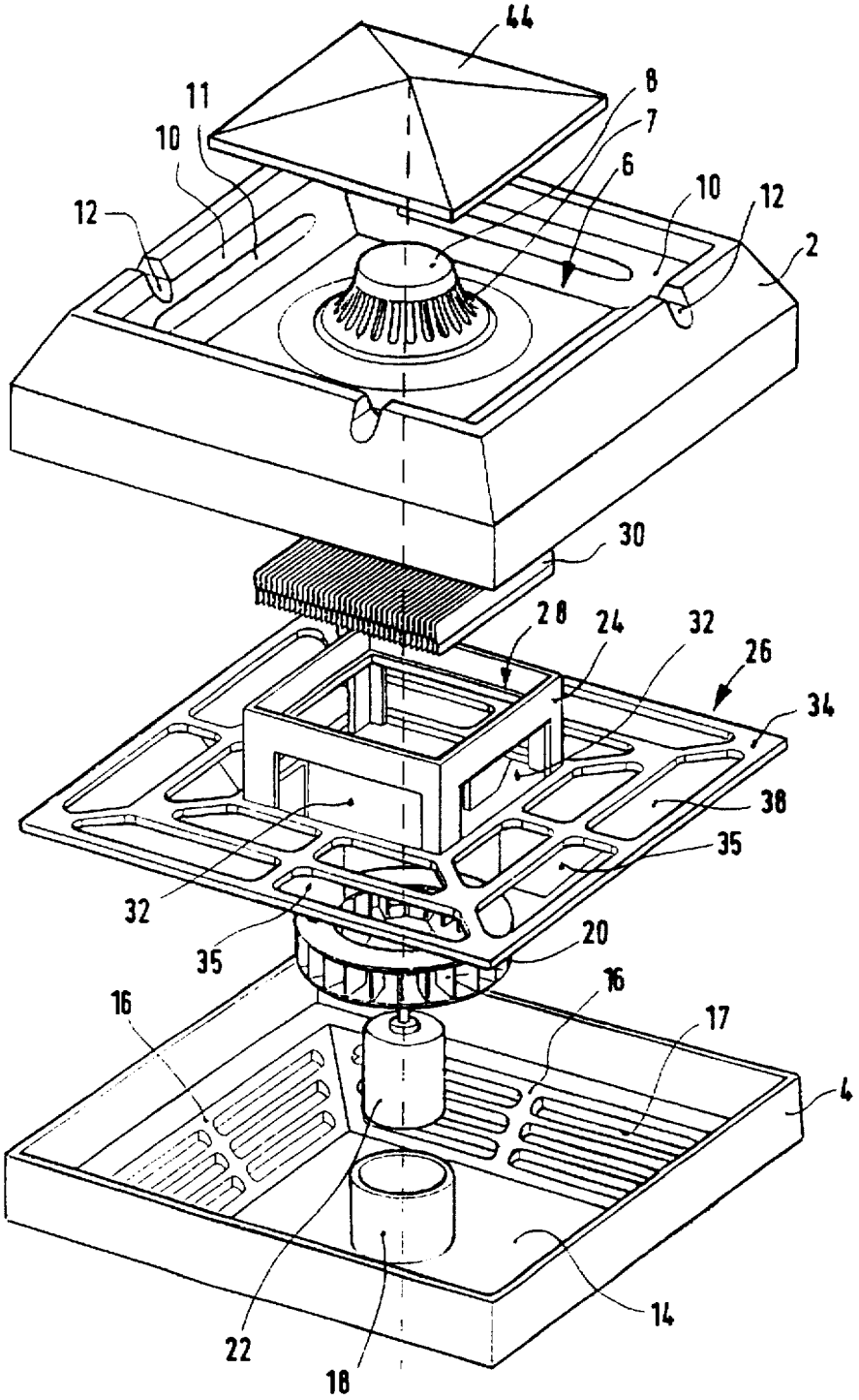
FIG. 1 shows an exploded view of an ashtray.

As shown in FIG. 1, the ashtray comprises a casing having an upper, ashtray portion 2 and a lower, base portion 4. The ashtray portion 2 has a well 6 in which cigarette ends may be placed. In the centre of the ashtray portion 2, there is defined an air inlet manifold 8, which, together with side portions 10 of the ashtray portion 2 defines the well 6. Cigarette support slots 12 are provided around the periphery of the ashtray portion 2, as is known from conventional ashtrays.

The base portion 4 of the ashtray comprises a supporting base 14 from which base side walls 16 extend.

A casing is defined by the ashtray portion 2 and the base portion 4 which houses a fan 20 driven by a motor 22. The supporting base 14 has a support structure 18 for the motor 22.

The fan 20 is a centrifugal fan and is disposed in a substantially horizontal plane (with respect to the normal orientation of the ashtray). In this way, the fan draws in from above and expels air laterally outwardly. The fan 20 is positioned within a fan housing 24 which is defined by a filter support element 26. The top of the fan housing 24 has a support flange 28 for supporting a first filter element 30, and has lateral openings 32 which, when the ashtray is assembled, provide openings for the air expelled by the fan 20. The filter support element 26 further comprises a peripheral flange 34 which surrounds the fan housing 24 and which provides support for a second filter element 36 (not shown in FIG. 1). The peripheral flange 34 has openings 38 enabling the passage of air across the flange 34.

Figure 2:
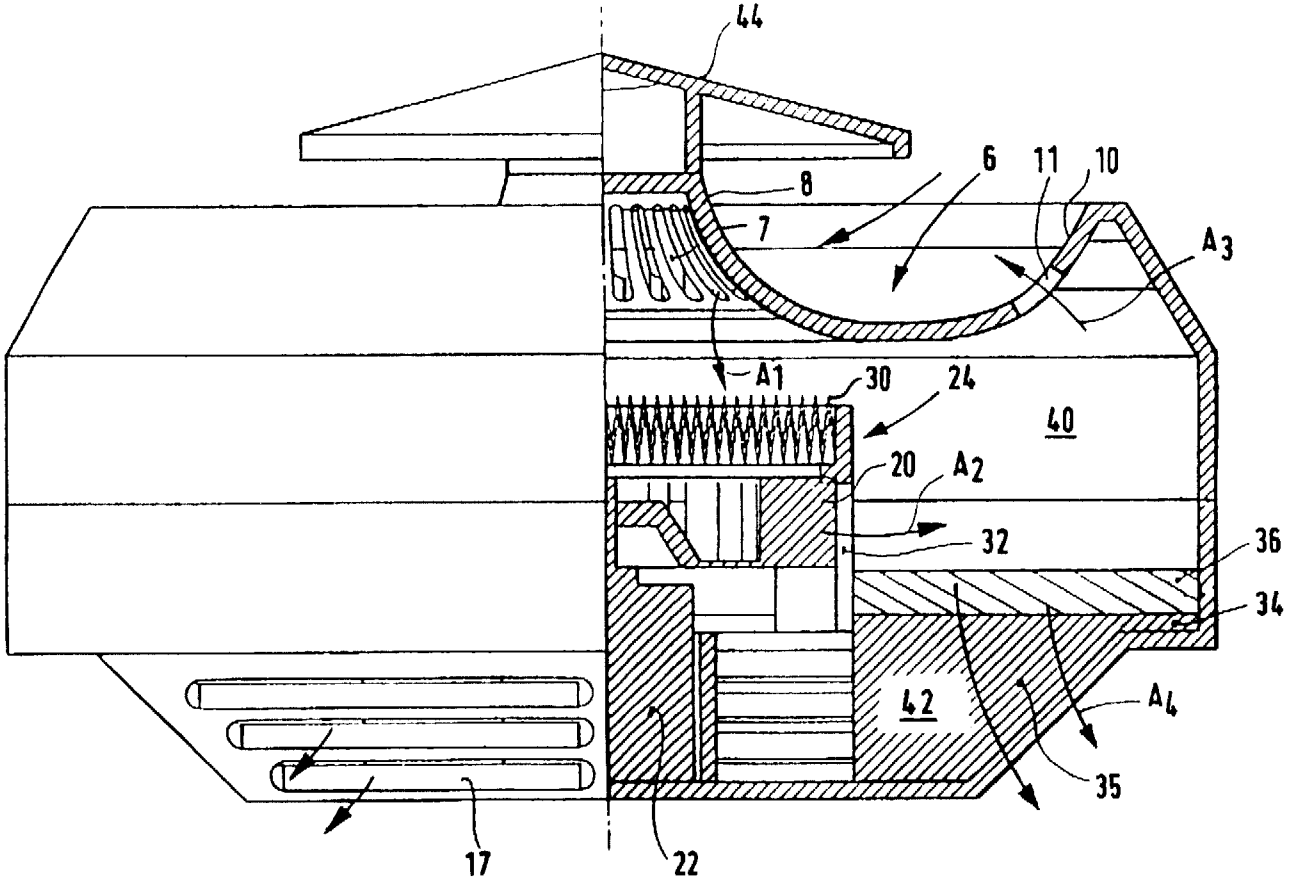
FIG. 2 shows a cross-sectional view of the ashtray.

The ashtray is shown assembled in FIG. 2, and the operation of the ashtray will be described with reference to FIG. 2. The flow of air through the ashtray is represented by arrows A. As shown, the fan 20 draws air in from above, as represented by arrow $A_1$. This air passes through the first filter 30 before reaching the fan 20 and is originally drawn from the well 6 through openings 7 in the air inlet manifold 8. The air is expelled laterally by the fan 20 as shown by arrow $A_2$. This air passes through the lateral openings 32 of the fan housing 24.

The filter support element 26 divides the internal volume of the casing into a first section 40 and a second section 42. The air expelled from the lateral openings 32 enters the first section 40 and can either return to the well 6 as shown by arrow $A_3$ through openings 11 provided in the side portions 10, or may pass through the second filter element 36 into the second section 42. The relative impedances provided by the recirculation path and the second filter element 36 will determine the proportions of air recirculated and expelled.

The recirculation provided by arrows $A_1$, $A_2$ and $A_3$ enables significant filtering of the air before it passes through the second filter 36. Furthermore, the air return path provided by the return opening 11 enhances the drawing in of smoke by the air inlet manifold 8. The recirculation enables the size of the filter elements to be reduced whilst achieving a desired filtering efficiency.

The second filter element 36 is supported on the peripheral flange 34 which is firmly supported by the base portion 4 by means of flange elements 35.

Air which has passed through the second filter element 36 is expelled through openings 17 in the base sidewalls 16.

The ashtray is provided with a cover portion 44 disposed over the air inlet manifold 8 to promote flow of air into the openings 7 from the periphery of the ashtray portion 2.

The filter support element 26 provides support for first and second filter elements 30, 36 and enables the fan 20 to be disposed between these two filter elements. This enables the first filter 30 to carry out the majority of the filtering action, and therefore the filter 30 may be constructed as a replaceable filter element, and a corrugated absorbent structure is represented. The first filter 30 may include more than one filtering stage. The second filter element is preferably a carbon filter which may be replaced less frequently than the pre-filter or first filter element, 30. The second filter element 36 may also comprise a number of filtering stages.

The fan is preferably a centrifugal fan, as shown in the diagrams although other fan arrangements could be envisaged, for example a straight through fan design. Electric motor 22 is shown in the diagrams for driving the fan, and of course provision must be made for a power source, such as a battery and an on-off switch. It would, however, also be possible to envisage a wind-up power source for the fan, particularly as the ashtray fan need only operate for limited periods of time.

The recirculation has been described as being effective through one of two filters. Recirculation may take place through all filter elements provided within the casing, provided appropriate air paths are provided. This could, for example, require closable venting to control whether there is recirculation or an air path straight through the casing. There may, of course, only be provided a single filter if this is desired.

From reading the present disclosure, other modifications will be apparent to persons skilled in the art. Such modifications may involve other features which are already known in the design and use of air circulation and filtering systems and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalization of one or more of those features which would be obvious to persons skilled in the art, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

I claim:

1. An ashtray comprising a casing housing a driven fan, the casing including at least one upper opening in an upper, external ashtray portion of the casing and at least one lower opening in a lower portion of the casing, the fan being disposed between, and generating a flow of air between, the upper portion and the lower portion of the casing, filtering means being located between the upper opening and the lower opening, an air return path being provided enabling the flow of air which has passed through the filtering means from within the casing to the ashtray portion of the casing.

2. An ashtray as claimed in claim 1, wherein the upper opening is defined at a central portion of the ashtray portion, and the air return path is defined by at least one return opening in a peripheral area of the ashtray portion.

3. An ashtray as claimed in claim 1, wherein the filtering means comprises first and second filter means, the air return path enabling the flow of air from between the first and second filter means to the ashtray portion.

4. An ashtray as claimed in claim 3, wherein the first filter means is located in the air flow path between the upper opening and the fan.

5. An ashtray as claimed in claim 4, wherein the second filter means is located in the air flow path between the fan and the lower opening.

6. An ashtray as claimed in claim 1, wherein the fan comprises a centrifugal fan.

7. An ashtray as claimed in claim 6, wherein the fan is arranged in the casing such that air is drawn into the fan from above and is expelled laterally.

8. An ashtray as claimed in claim 6, further comprising a filter support element comprising a fan housing portion including an upper support which supports the first filter means, lateral openings below the upper support, and a lower support disposed around the lateral openings and which supports the second filter means, the fan being positioned within the fan housing portion so as to draw air in through the first filter element and expel air through the lateral openings.

9. An ashtray as claimed in claim 8, wherein the filter support element divides the casing into an upper section and a lower section, the upper section communicating with the ashtray portion through the return opening and with the lower section through the second filter means, and the lower section communicating with the outside of the ashtray through the lower opening.

10. An ashtray as claimed in claim 1, wherein the fan is a motor driven fan.

* * * * *